US006666339B2

(12) United States Patent
Platek

(10) Patent No.: US 6,666,339 B2
(45) Date of Patent: Dec. 23, 2003

(54) BALL DISPLAY ASSEMBLY

(75) Inventor: David F. Platek, 600 61st St., Lisle, IL (US) 60532

(73) Assignee: David F. Platek, Lisle, IL (US)

( * ) Notice: Subject to any disclaimer, the term of this patent is extended or adjusted under 35 U.S.C. 154(b) by 0 days.

(21) Appl. No.: 10/057,375

(22) Filed: Jan. 25, 2002

(65) Prior Publication Data

US 2003/0141262 A1 Jul. 31, 2003

(51) Int. Cl.[7] ..... A47F 7/00
(52) U.S. Cl. ..... 211/14; 211/120; 47/41.13
(58) Field of Search ..... 211/14, 120; D6/552; 366/129; 28/150; 47/41.13

(56) References Cited

U.S. PATENT DOCUMENTS 557,622 A * 4/1896 Spurr ..... 99/440
565,260 A * 8/1896 Cook ..... 416/70 R
866,909 A * 9/1907 Brenner ..... 416/70 R
1,410,522 A * 3/1922 Ziemba ..... 416/70 R
1,573,911 A 2/1926 Budrow
1,860,405 A * 5/1932 Cheeswright ..... 47/41.13
2,050,893 A * 8/1936 Osterlund Nee Malmqvist ..... 47/41.13
2,208,337 A * 7/1940 Maslow ..... 416/70 R
2,884,250 A 4/1959 Patterson
3,087,280 A * 4/1963 Seliger ..... 47/41.13
3,412,983 A * 11/1968 Kesilman et al. ..... 416/70 R
3,414,268 A 12/1968 Chase
3,991,983 A * 11/1976 Drynan ..... 366/129
4,176,838 A 12/1979 Griffin
4,181,311 A 1/1980 Lawlor
4,796,885 A 1/1989 Wright
4,976,431 A 12/1990 Guenther
4,979,741 A 12/1990 Butcher
5,100,134 A 3/1992 Becker
D369,845 S 5/1996 Knez
5,788,368 A * 8/1998 Anderson et al. ..... 366/129
D404,448 S 1/1999 Lawrence
6,053,822 A 4/2000 Kolodney et al.
6,206,561 B1 * 3/2001 Hefti ..... 366/129

* cited by examiner

*Primary Examiner*—Daniel P. Stodola
*Assistant Examiner*—Khoa Tran
(74) *Attorney, Agent, or Firm*—Welsh & Katz, Ltd.

(57) ABSTRACT

A display assembly for supporting an object includes three loops, each loop formed from an elongated flexible element. Each loop is formed so as to define an apex. The apices of the three loops define a plane. The three loops are non-linear and are in secured relation to one another by a retaining member. The loops form a petal like support.

6 Claims, 1 Drawing Sheet

BALL DISPLAY ASSEMBLY

BACKGROUND OF THE INVENTION

The present invention pertains to a support assembly. More particularly, the present invention pertains to a flexible ball display assembly for supporting and displaying an associated ball in an exposed position.

Ball support devices used in sports are generally known. Such devices are used to display an associated ball at desired elevated position, such that a user or player can strike the ball. In general, the bottom portion of the associated ball is placed in contact with an upper portion of the device. Unfortunately, a player attempting to strike the ball may accidentally strike the support device as well, causing damage to device.

In general, the greater the contact surface area shared between the ball and the support device the greater the possibility that the device can obstruct the player's contact with the ball and be hit by the player. Such an obstruction can undesirably effect the movement, speed and trajectory of the ball upon contact and as mentioned, can damage the support device as well.

Conventional ball support devices are generally fixed to a stand that elevates the ball from the ground. Unfortunately, a support device fixed in such manner requires that the entire structure and stand be moved to move the support device. One known support device is a baseball "T". Such a device generally includes an open cup-shaped holder for supporting the ball. These "Ts" are typically formed from a solid sheet of, for example, plastic. One drawback to such a "T" is that it reduces the area available to strike the ball, thus obstructing the player's swing. Another drawback is that these known "Ts" are readily damaged when, for example, the player strikes the "T" rather than the ball.

Accordingly, there exists a need for a non-obstructing ball support assembly having a flexible support portion and body. It is desirable that the flexible support portion is able to absorb repetitive high-speed contact from a user's swing. It is also desirable that the assembly includes a non-obstructing support configuration providing a reduced surface contact with the ball to reduce obstruction of the ball. It is further desirable that such assembly had an adaptable mount which enables the assembly to be easily moved and mounted to a variety of different sized conduits or similar type of structures.

BRIEF SUMMARY OF THE INVENTION

A display assembly for supporting an object, such as a ball includes and upper layer formed from loops, each loop formed from an elongated flexible element. Each loop is formed so as to define an apex. The apices of the three loops define a plane. The three loops are non-linear and are in secured relation to one another by a retaining member. The loops form a petal like support.

The display assembly includes a display portion (the petal like support) that is configured for displaying an object such as a ball in an elevated and readily viewed and accessible manner. The support can be used to, for example, support a baseball for hitting practice. The support can also be used as a stand to exhibit a novelty ball (e.g., an autographed baseball) or other object.

In a preferred assembly, the elongated flexible elements are first elements, and the display further includes a lower or support layer for supporting the upper petal like support. In the preferred embodiment, the display assembly includes six first elements forming six loops in the upper layer and six second elements forming six loops in the lower layer. Each set of loops can be formed from individual elements.

Preferably, the upper and lower layers of loops are interwoven to enhance the support of the upper layer. In the configuration, the lower layer of loops are disposed externally of the upper layer and to urge the petal-like supports (upper layer) toward one another.

The display assembly includes a base. In a current embodiment the elements forming the upper layer of loops each include leg portions that extend from the retaining member to the base.

The base has a body including a top portion and a bottom portion. A stabilizing portion includes a plurality of flexible elements that extend helically outwardly from the base from the top portion to the bottom portion. The flexible elements enable connection of the display assembly with the inside of an associated conduit.

These and other features and advantages of the present invention will be apparent from the following detailed description, in conjunction with the appended claims.

BRIEF DESCRIPTION OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
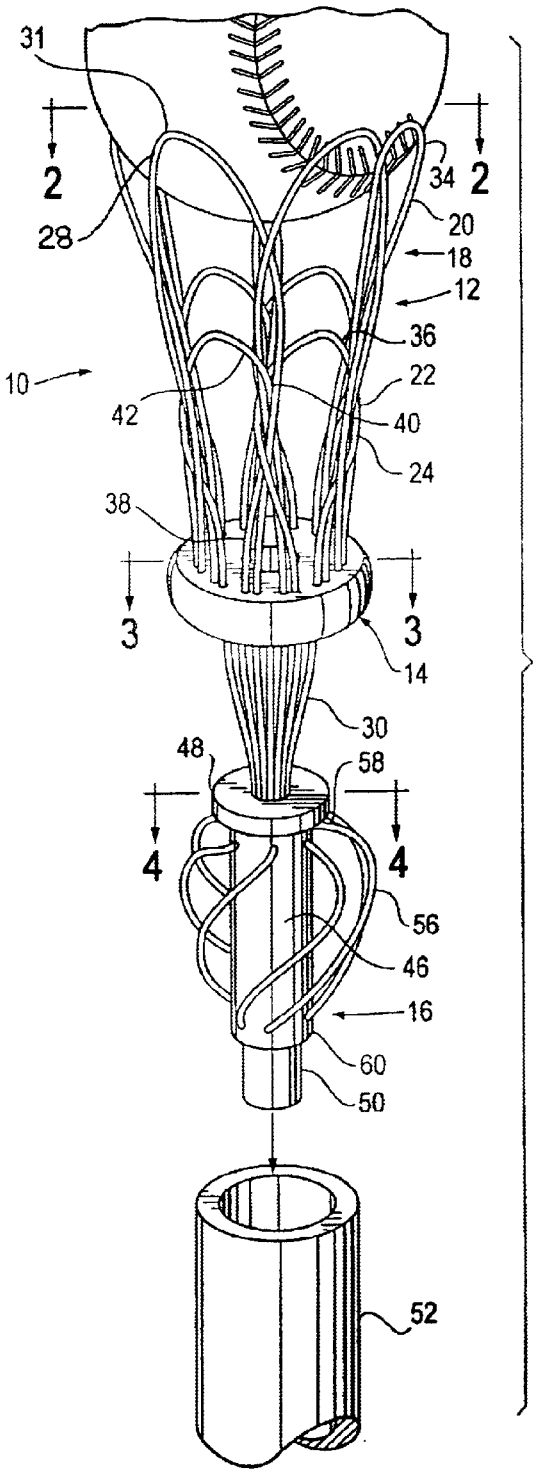
FIG. 1 is a perspective view of a ball display assembly embodying the principles of the present invention, the display assembly being illustrated with a baseball (illustrated in part) seated in the display portion.
Figure 2:
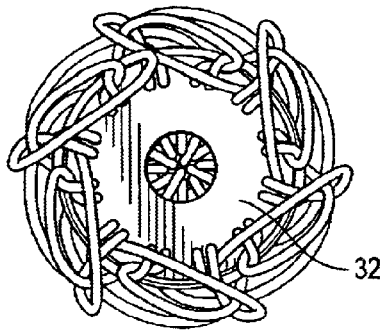
FIG. 2 is a top view of the ball support display portion taken along line 2—2 of FIG. 1.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated. It should be further understood that the title of this section of this specification, namely, "Detailed Description Of The Invention", relates to a requirement of the United States Patent Office, and does not imply, nor should be inferred to limit the subject matter disclosed herein.

In the present disclosure, the words "a" or "an" are to be taken to include both the singular and the plural. Conversely, any reference to plural items shall, where appropriate, include the singular.

Referring now the drawings and more particularly FIG. 1, there is shown a ball display assembly 10 embodying the principles of the present invention. The ball display assembly 10 enables a user to place an object, such as ball B, on the assembly 10 in a generally exposed or unobstructed position. The ball display assembly 10 includes a display portion 12, a retaining member or guide component 14, and a base portion 16. The display portion 10 is configured for displaying an object such as the exemplary ball B in an elevated and readily viewed and accessible manner.

The display portion 12 includes an upper support layer 18 formed from one or more elongated first elements or filaments 20, and a lower support layer 22 formed from one or more elongated second elements or filaments 24. Preferably, the elements 20, 24 have a generally flexible thin shape, which enables the elements 20, 24 to be bent or shaped into loops and/or layers of interwoven loops. It is also preferable that the elements 20, 24 are formed from a material such as plastic or metal having sufficient stiffness, tensile strength and resilience to enable them to support the desired object and to withstand an impact and return to their original shape or configuration.

The first or upper support layer 18 is formed by a plurality of the elongated elements 20, each formed as a looped support portion 28. Each element 20 includes leg portions 30 extending from the base portion 16 to the retaining member 14, and the looped support portion 28 extending upwardly from the retaining member 14, generally transverse thereto. The looped support portions 28 are provided for receiving the lower portion of, for example, the exemplary ball B. The loops 28 each define an apex 31 and the apices 31 of the loops 28 define a plane (not shown). The apices 31 are configured in a triangular pattern defining three angles. Preferably, each angle is less than 90 degrees.

The loops 28 are generally non-linear and secured to one another by the retaining member 14. The loops 28 extend upwardly from the retaining member 14 to form the petal-like display portion 12. The petals, which are defined by the loops 28 are circumferentially disposed about the display portion 12 (and the retaining member 14) to define a central space 32 between the loops 28. This space 32 provides for receiving or displaying the ball B or another like object.

Each leg portion 30 has a predetermined length. By varying the lengths of the leg portions 30, the stiffness of the display assembly 10 can be varied. For example, by reducing the length of the leg portions 30, the stiffness is increased. Conversely, by increasing the leg portion 30 lengths, the stiffness is reduced.

In a preferred embodiment, the display portion 12 includes at least three first elements 20 (to define a plane) forming three loops 34 for supporting the ball B. In a current embodiment, the display portion 12 includes six loops 34.

The lower support layer 22 provides support for the upper support layer 18. The lower support layer 22 is formed from a plurality of second elements 24 formed as a plurality of support loops 36. As illustrated in FIG. 1, the second elements 24 extend upwardly from the retaining member 14, and do not extend through the member 14 to the base 16. Those skilled in the art will, however, recognize that the second elements 24 can be configured to extend fully through the retaining member 14 to the base 16 similar to the first elements 20.

In the illustrated embodiment, the elements 20 which form the upper support layer 18 and the elements 24 which form the lower support layer 22 are interwoven in a grouped arrangement so that the lower layer 22 supports the upper layer 18. As can be seen from a study of the figures (and in particular FIGS. 1 and 3), the first elements 20 traverse through the retaining member 14 at two relatively close, but spaced locations, thus forming the upper loop 34. Each upper loop 34 has a lower loop 36 associated with it. The element 24 that forms the lower loop 36 traverses into the retaining member 14, again at two locations, to form the lower loop 36. The locations at which the lower loop element 24 enters the retaining member 14 is between those locations at which the upper loop element 20 traverses through the member 14. Thus, the lower loop 36 is positioned "inside of" the upper loop 34. The locations at which the upper and lower loop elements 20, 24 traverse or enter the retaining member 14 provide anchor points for the elements 20, 24.

In addition, the lower loop 36 is "weaved with" the upper loop 34 to enhance the support capabilities of the upper loop 34. The lower loop element 24 traverses up from the retaining member 14 on the inside of the upper loop 34, as indicated at 38. The element 24 then wraps to the outside of the upper loop 34 (as indicted at 40) and then comes behind the upper loop 34 (as indicated at 42). The lower loop 36 is then formed outside of or behind the upper loop 34, and returns to the retaining member 14 in the same manner. In this configuration, the lower loop 36 supports the upper loop 34 and urges the upper loop 34 inwardly of the space 32.

Figure 3:
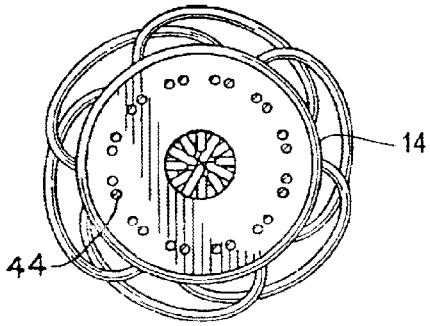
FIG. 3 is a top view of the guide member taken along line 3—3 of FIG. 1.

Referring now to FIGS. 1 and 3, the retaining member 14 is positioned between the base portion 16 and the display portion 12 and stabilizes the display portion elements 20, 24. The retaining member 14 includes a plurality of holes or openings 44, for receiving and securing the elements 20, 24. As illustrated in FIG. 3, the holes 44 are equidistantly spaced about a selected radius.

By varying the position of the retaining member 14 between and relative to the display portion 12 and the base 16, the stiffness or resistance to lateral forces can be varied. For example, to increase the stiffness of the display 12, the distance between the retaining member 14 and the display portion 12 can be reduced.

The base 16 includes a body 46, an upper flange or cap 48 and a lower end or plug 50. Preferably, the base 16 has a generally cylindrical shape to enable ready insertion and mounting into an associated conduit 52 or like structure. The base 16 can have virtually any shape without departing from the scope of the present invention. The flange 48 can be formed integral with or as part of the base 16 to enhance the structural strength of the base 16. The flange 48 can be configured to rest on an upper portion or edge of the conduit 52 for securing the display 10 to the conduit 52. The body 46 includes at least one opening 54 (also through the flange 48) for receiving and/or retaining the leg portions 30 of the elements 20.

Figure 4:
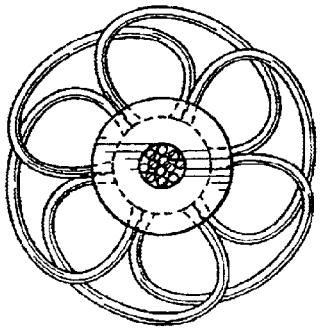
FIG. 4 is a top view of the base portion taken along line 4—4 of FIG. 1.
Figure 5:
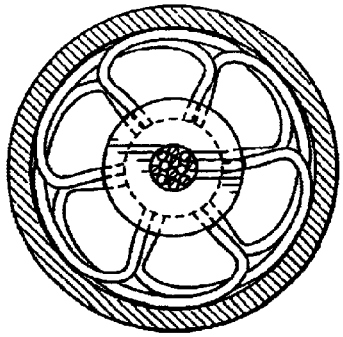
FIG. 5 is a view of the base portion inserted in an associated conduit.

The base 16 includes one or more stabilizing elements 56 for securing the display assembly 10 in an upright position when inserted in the conduit 52. In a present embodiment, the stabilizing elements 56 are formed as a plurality of filaments extending in an outwardly helically-curved manner from the body 46. As illustrated in FIGS. 1, 4, and 5, the stabilizing elements 56 extending outwardly from an upper portion 58 of the body 46 and wrap helically around the body 46 connecting at a lower portion 60 of the body 46. Like the elements 20, 24 forming the upper and lower loops 34, 36, the stabilizing elements 56 are preferably formed from a material such as plastic or metal having sufficient stiffness, tensile strength and resilience to enable them to maintain the display 10 in the conduit 52 and to withstand the stresses and forces that will be transferred to the elements 56 due to impact on the display 10.

Those skilled in the art will recognize that the material selected for the elements 20, 24 can vary to achieve a desire shape and strength. Likewise the diameter of each element 20, 24 and the lengths of the elements 20, 24 can vary as well. to achieve a desired configuration and strength for a given use (e.g., youth T-ball vis-a-vis high school baseball batting practice) of the display 10.

Those skilled in the are will also recognize that although the present display 10 has been presented and disclosed having discrete elements 20, 24 forming each of the upper and lower loops 34, 36, a single wrapped or bent element can be used to form more than a single loop, which configuration is within the scope and spirit of the present invention.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A display assembly for supporting an object comprising:

at least three upper loops, each upper loop formed from an elongated first flexible element, each upper loop formed so as to define an apex, the apices of the at least three upper loops spaced from one another and defining a plane, the at least three upper loops being non-linear and being in secured relation to one another by a retaining member, the at least three upper loops forming a petal shaped support, the display including at least three lower loops interwoven with the at least three upper loops to support the at least three upper loops.

2. The display assembly of claim 1, including six upper loops.

3. The display assembly of claim 2, including six upper loops and six lower loops.

4. The display assembly of claim 1, including a base, wherein the elements include leg portions extending from the retaining member to the base.

5. The display assembly of claim 4, the base having a body including a top portion and a bottom portion.

6. The display assembly of claim 5 wherein the base includes a stabilizing portion including a plurality of flexible elements extending helically outwardly from the base from the top portion to the bottom portion, enabling connection with the inside of an associated conduit.

* * * * *